US007973757B2

(12) United States Patent
Lee et al.

(10) Patent No.: US 7,973,757 B2
(45) **Date of Patent: *Jul. 5, 2011**

(54) LIQUID CRYSTAL DISPLAY

(75) Inventors: Seok Lyul Lee, Tao-Yuan Hsien (TW); Po Sheng Shih, Tao-Yuan Hsien (TW)

(73) Assignee: Hannstar Display Corporation, Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/854,931

(22) Filed: Aug. 12, 2010

(65) Prior Publication Data

US 2010/0321358 A1 Dec. 23, 2010

Related U.S. Application Data

(60) Division of application No. 11/946,902, filed on Nov. 29, 2007, now Pat. No. 7,800,579, and a continuation of application No. 10/777,164, filed on Feb. 13, 2004, now Pat. No. 7,321,355.

(30) Foreign Application Priority Data

Mar. 7, 2003 (TW) ..... 92105061 A

(51) Int. Cl.
*G09G 3/36* (2006.01)

(52) U.S. Cl. ..... 345/100; 345/103

(58) Field of Classification Search ..... 345/87, 345/90–92, 94–96, 103, 100
See application file for complete search history.

(56) References Cited

U.S. PATENT DOCUMENTS

| | | | | |
|---|---|---|---|---|
| 5,151,805 | A * | 9/1992 | Takeda et al. | 345/94 |
| 5,706,023 | A * | 1/1998 | Nagata et al. | 345/92 |
| 7,321,355 | B2 * | 1/2008 | Lee et al. | 345/103 |
| 7,800,579 | B2 * | 9/2010 | Lee et al. | 345/103 |

* cited by examiner

*Primary Examiner* — Ricardo L Osorio
(74) *Attorney, Agent, or Firm* — Volentine & Whitt, PLLC

(57) ABSTRACT

A liquid crystal display replaces the common electrodes of a conventional LCD with a plurality of switch electrodes. The plurality of switch electrodes is grouped into several switch electrode sets. Each of the switch electrode sets' potential is modulated by a different driving circuit. The driving circuits can also separately modulate the potentials of the switch electrode sets according to the scanning sequence of the LCD.

15 Claims, 8 Drawing Sheets

LIQUID CRYSTAL DISPLAY

CROSS REFERENCE TO RELATED APPLICATIONS

This application is a divisional application of prior-filed U.S. patent application Ser. No. 11/946,902 filed Nov. 29, 2007, which is a continuation application of application Ser. No. 10/777,164 filed Feb. 13, 2004, is issued as U.S. Pat. No. 7,321,355 on Jan. 22, 2008, and is based on and claims priority from R.O.C Patent Application No. 092105061 filed Mar. 7, 2003.

BACKGROUND OF THE INVENTION

1. Field of the Invention

The present invention relates to a liquid crystal display (LCD), and more particularly to an active matrix LCD rearranging the layout of its common electrode and modifying a corresponding driving method.

2. Description of the Related Art

The image quality of LCDs deteriorates due to a flicker phenomenon, which is directly relative to the sensitivity of the naked eye. Thin film transistor LCDs (TFT-LCDs) and super twisted nematic LCDs (STN-LCDs) are now generally used for display apparatuses. Unfortunately, both of them also have flicker problems. In most cases, to avoid flicker images, LCDs must be driven in an AC electrical field, because polarity inversion is needed. In LC cells, we find that flicker is mainly caused by the mobile ion charges, even though a higher frequency AC applied to the LC cells can reduce the flicker phenomenon. But power consumption is dependent on the frequency of the AC electrical field. On the other hand, due to a stray capacitor effect, the center level of driving signals shifts between two consecutive frame periods, so the amplitudes of the driving signals are different between the positive polarity and the negative polarity of the LC cells. Therefore, the flicker problem becomes worse.

FIG. 1 is an equivalent circuit diagram of a conventional LCD. The LCD 10 has a plurality of pixels 16 formed by a plurality of parallel data lines 13 perpendicularly crossing a plurality of parallel scanning lines 14. Each of the pixels 16 further includes a thin film transistor (TFT) 161 and an LC capacitor 162 that controls the rotation directions of LC molecules. The data lines 13 and scanning lines 14 respectively transmit driving signals generating from a data driver module 11 and scanning driver module 12, and the driving signals can drive each pixel 16 to have a proper gradation on its color. All the LC capacitors 162 electrically shorting to one of the scanning lines 14 are together electrically connected to a common electrode 151, and all the common electrodes 151 short to a principal common electrode 15 whose potential is driven by a modulation signal source 17.

Generally speaking, in the duration of polarity inversion, the potential of the common electrode 151 can synchronously vary with the variation of the potential of pixel electrodes so as to reduce the operating range of the potential for the pixel electrodes. For example, a 15 inch LCD having 1024×768 pixels execute polarity inversion by row inversion. The principal common electrode 15 needs to have its potential modulated once after each row of the pixels is scanned. We can assume that a vertical scanning frequency is 60 Hz, and the modulation signal source 17 must have a potential modulation frequency around 768×60=46,080 Hz. However, all the common electrodes 151 on the display also have to vary their potentials synchronously with the modulation frequency, thus too much electrical power would be wasted.

SUMMARY OF THE INVENTION

The first objective of the present invention is to provide a liquid crystal display whose common electrodes are grouped into several sets. The potential of each set is independently modulated by a different driving circuit. During a vertical scanning period, these driving circuits can separately or non-synchronously modulate the potentials of these sets; hence modulation frequency and power consumption can be quite reduced.

The second objective of the present invention is to provide a liquid crystal display that can eliminate an image-sticking phenomenon so as to avoid the overlap of the images of two adjacent frames.

The third objective of the present invention is to provide a liquid crystal display that can eliminate the flicker phenomenon and reduce power consumption under a lower modulation frequency.

The fourth objective of the present invention is to provide a liquid crystal display that can shorten its response time and reduce the delay effect caused from the long transmission distance of electrical signals by separately or non-synchronously varying the potentials of the sets of common electrodes.

In order to achieve the objective, the present invention discloses a liquid crystal display that replaces the common electrodes of a conventional LCD with a plurality of switch electrodes. The plurality of switch electrodes is grouped into several switch electrode sets. Each of the switch electrode sets' potential is modulated by a different driving circuit. The driving circuits can also separately modulate the potentials of the switch electrode sets according to the scanning sequence of the LCD.

BRIEF DESCRIPTION OF THE DRAWINGS

The invention will be described according to the appended drawings in which:

FIGS. 5(*b*)-5(*c*) are equivalent circuit diagrams of the shift register in FIG. 5(*a*);

FIGS. 6(*b*)-6(*c*) are equivalent circuit diagrams of the shift register in FIG. 6(*a*)

PREFERRED EMBODIMENT OF THE PRESENT INVENTION

Figure 1:
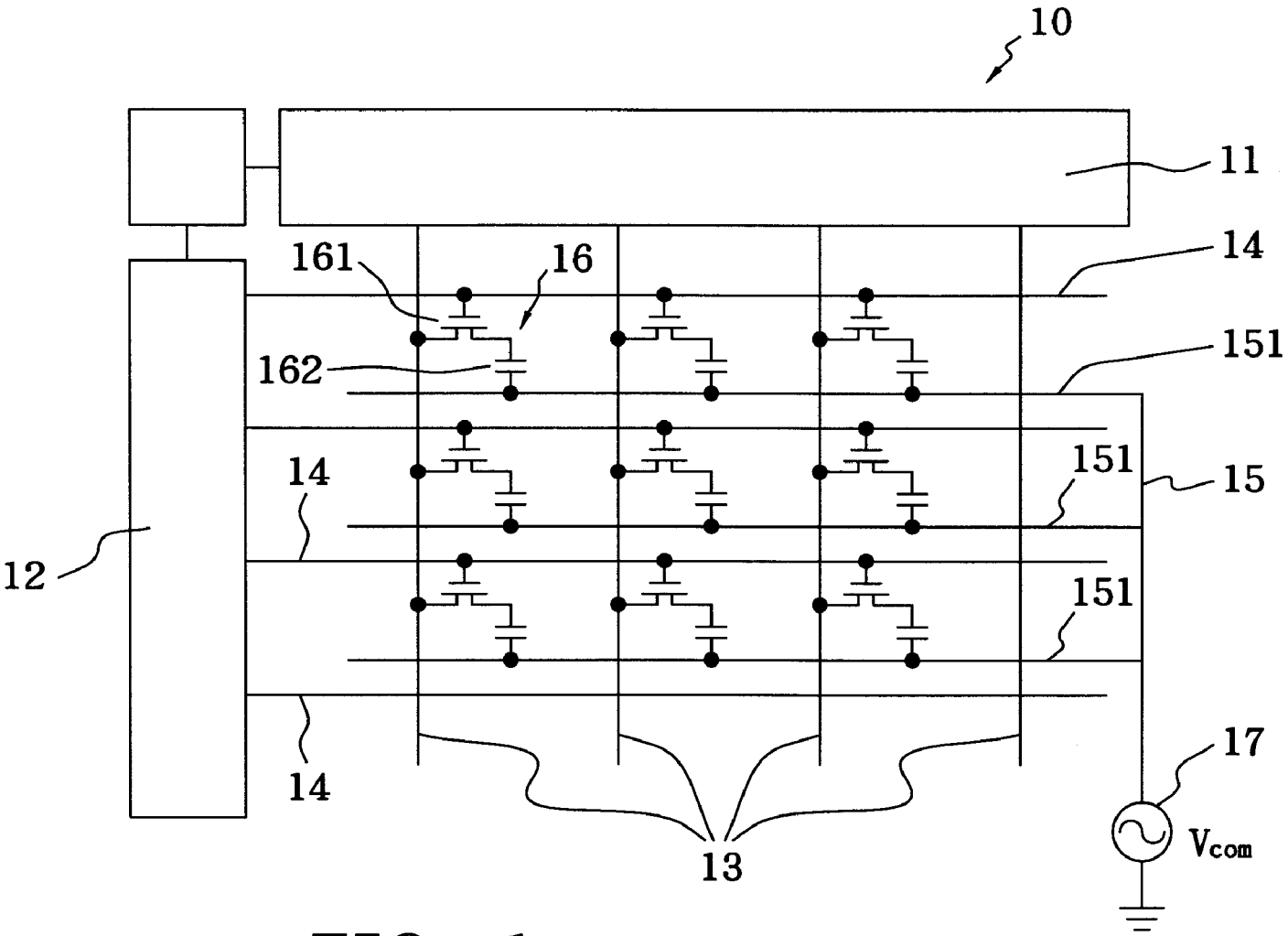
FIG. 1 (Background Art)
FIG. 1 is an equivalent circuit diagram of a conventional LCD.
Figure 2:
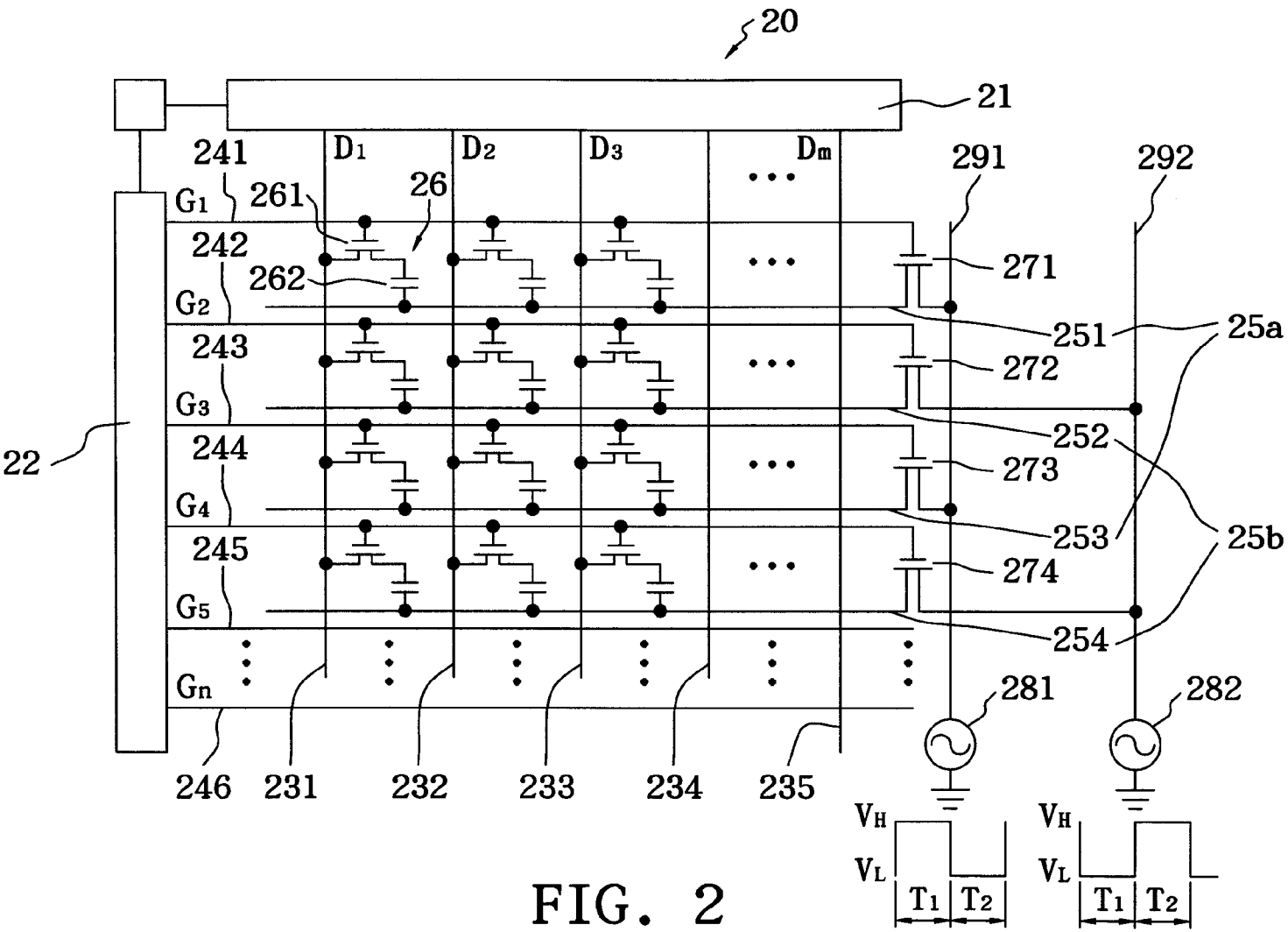
FIG. 2 is an equivalent circuit diagram of an LCD in accordance with the first embodiment of the present invention.

FIG. 2 is an equivalent circuit diagram of an LCD in accordance with the first embodiment of the present invention. The LCD 20 has a plurality of pixels 26 formed by a plurality of parallel data lines (D1-Dm) 231-235 perpendicularly crossing a plurality of parallel scanning lines (G1-Gn) 241-246. Each of the pixels 26 further includes a thin film transistor (TFT) 261 and an LC capacitor 262 that controls the rotation directions of LC molecules. The data lines 231-235 transmit driving signals generated from a data driver module 21, and the scanning lines 241-246 transmit driving signals generating from a scanning driver module 22. When the gate electrode of the TFT 261 of the pixel 26 is selected by the scanning signals, the TFT (n channel) 261 is turned on and allows a data signal to write into a storage capacitor. In the LCD 20 as shown in FIG. 2, all the LC capacitors 262 electrically shorting to a conductive line 2*a* are together electrically connected to a switch electrode 251, and their another terminals are respectively electrically shorts to their corresponding TFTs 261 of which gate electrodes are together electrically connected to the scanning lines 241. The other switch electrodes 252-254 are separately and electrically connected to the LC capacitors 262 through the conductive lines 2*b*-2*d*.

The side of the scanning line 241 that is opposite to a scanning driver module 22 is connected to the gate electrode of a transistor 271, and the source electrode and drain electrode of the transistor 271 is respectively connected to a first principle switch electrode 291 and the switch electrode 251. As shown in FIG. 2, the transistor 271-274 are not only placed at the side opposite to the scanning driver module 22, but also can be placed at the same or both side. A first signal source 281 applying to the first principle switch electrode 291 changes into a high potential VH during an interval T1; meanwhile, the scanning line 241 is selected to be at a high potential. Because the transistor 271 is turned on, the potential of the switch electrode 251 also changes into the same high potential VH. A next scanning line 242 adjacent to the scanning line 241 is connected to the gate electrode of a transistor 272, and a switch electrode 252 on the same row of the pixels that is connected to the drain electrode of the transistor 272. In addition, the source electrode of the transistor 272 is connected to a second principal switch electrode 292, which a second signal source 282 supplies signals to. The first signal source 281 and the second signal source 282 have opposite phases. That is, during the interval T1, the first signal source 281 remains at the high potential VH, but the second signal source 282 is at the low potential VL. When the next interval T2 comes, the first signal source 281 changes into the low potential VL, and the second signal source 282 also changes into the high potential VH.

According to the above operating principle of the circuit, the switch electrodes 251, 253, etc., belong to a first switch electrode set 25*a*, and all are connected to a first principal switch electrode 291. The switch electrodes 252, 254, etc., belong to a second switch electrode set 25*b*, and all are connected to a second principal switch electrode 292. During the interval T1, the first switch electrode set 25*a* remains at the high potential VH, but the second switch electrode set 25*b* is at the low potential VL. On the contrary, when the interval comes, the first switch electrode set 25*a* changes into the low potential VL, and the second switch electrode set 25*b* changes into the high potential VH. This polarity inversion can be regarded as a type of row inversion under the interlacing scanning sequence. It is preferred that the intervals T1 and T2 are separately equal to the vertical scanning period, hence the modulation frequencies of the first signal source 281 and the second signal source 282 are the same as the vertical scanning frequency.

Figure 7:
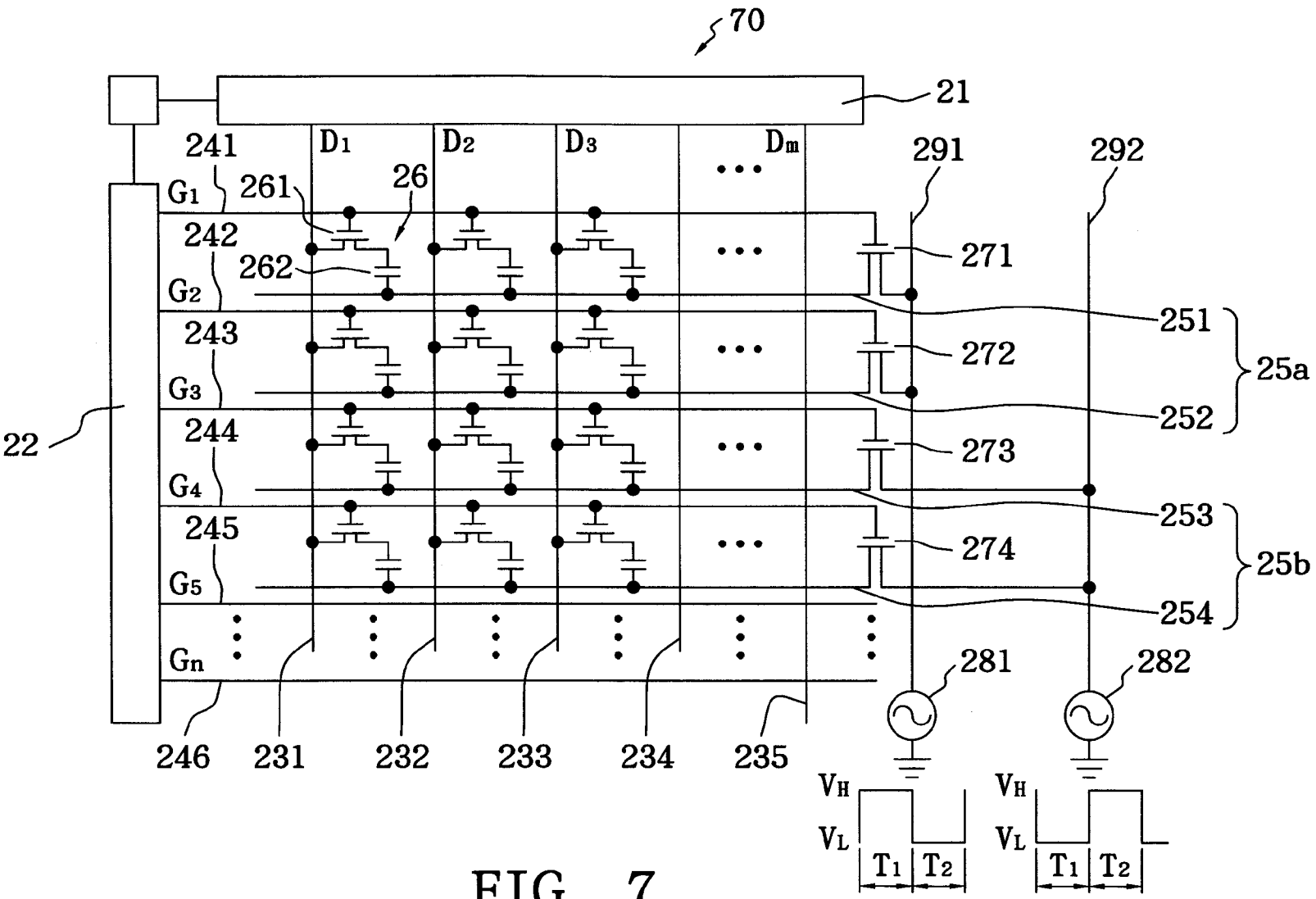
FIG. 7 is an equivalent circuit diagram of an LCD in accordance with the second embodiment of the present invention.

FIG. 7 is an equivalent circuit diagram of an LCD in accordance with the second embodiment of the present invention. In comparison with the first embodiment, this embodiment connects the first switch electrode set 25*a* including the switch electrodes 251 and 252 to the first principal switch electrode 291 together, and connects the second switch electrode set 25*b* including the switch electrodes 253 and 254 to the second principal switch electrode 292 together.

Figure 3A:
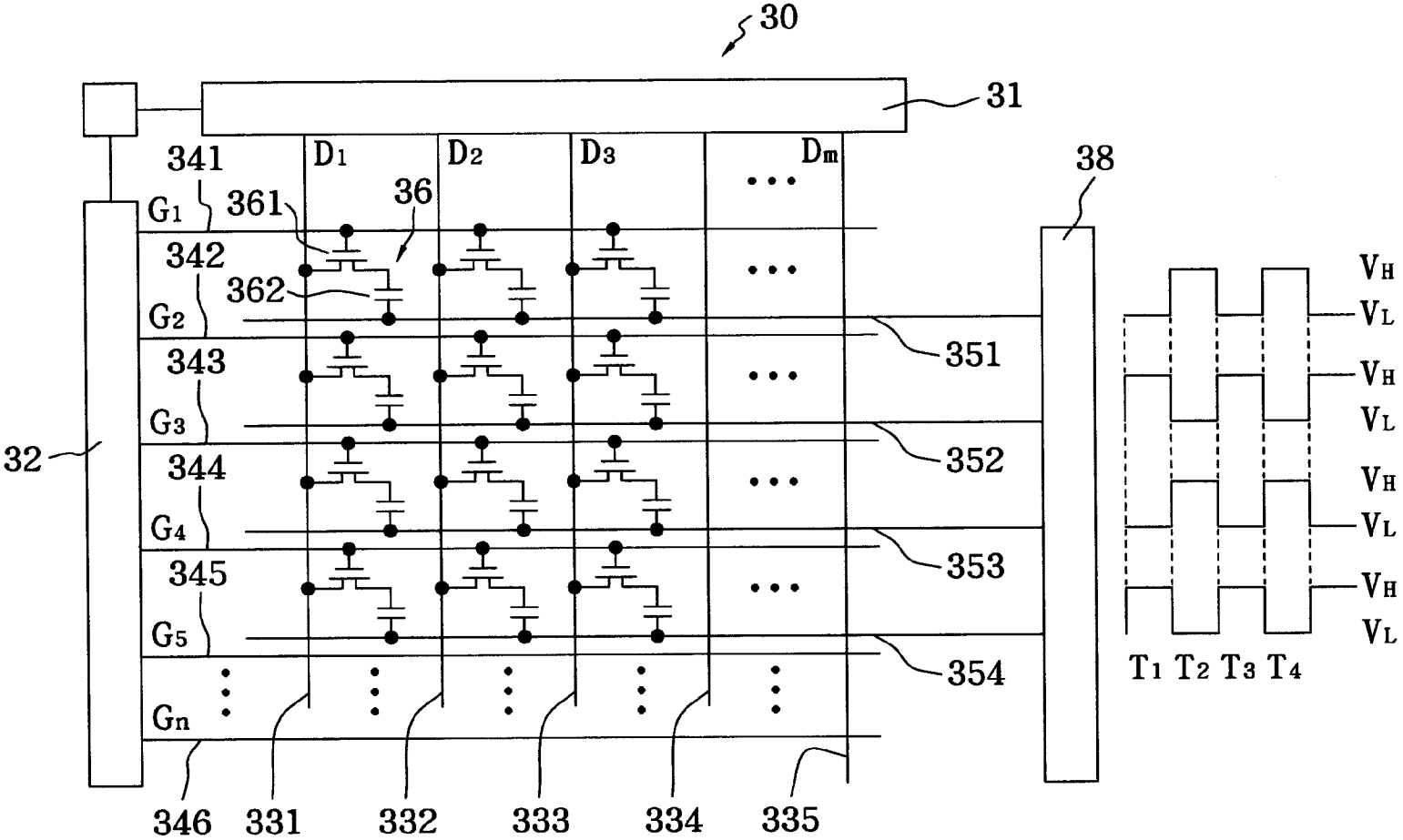
FIGS. 3(*a*)-3(*b*) is an equivalent circuit diagram of an LCD in accordance with the third embodiment of the present invention.
Figure 3B:
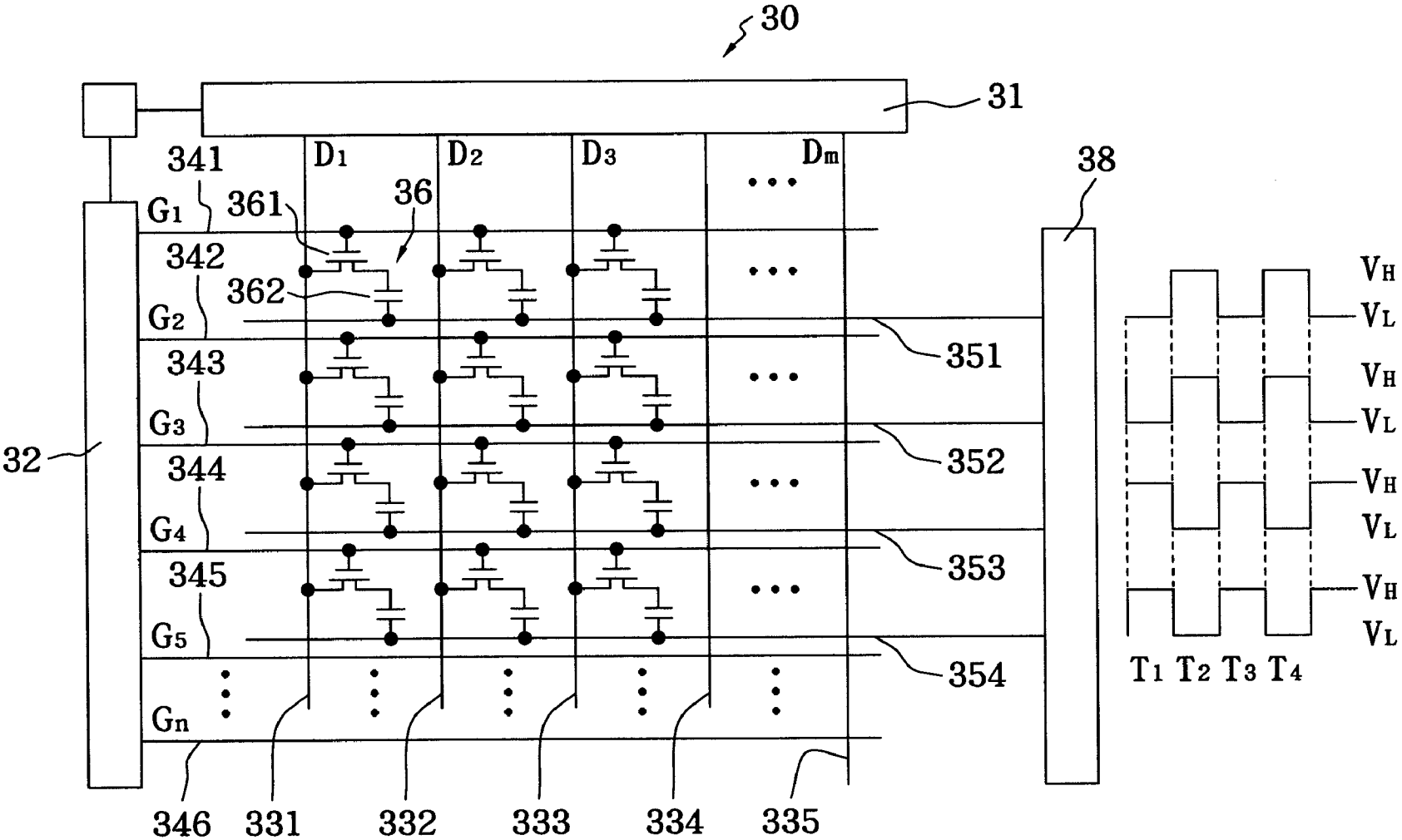

FIG. 3(*a*) is an equivalent circuit diagram of an LCD in accordance with the third embodiment of the present invention. The LCD 30 has a plurality of pixels 36 formed by a plurality of parallel data lines (D1-Dm) 331-335 perpendicularly crossing a plurality of parallel scanning lines (G1-Gn) 341-346. Each of the pixels 36 further includes a TFT 361 and an LC capacitor 362 that controls the rotation directions of LC molecules. The data lines 331-335 transmit driving signals generated from a data driver module 31, and the scanning lines 341-346 respectively transmit driving signals generated from a scanning driver module 32. In the LCD 30 as shown in FIG. 3(*a*), all the LC capacitors 362 electrically shorting to a conductive line 3*a* are together electrically connected to a switch electrode 351, and their another terminals are respectively electrically shorts to their corresponding TFTs 361 of which gate electrodes are together electrically connected to the scanning lines 341. The other switch electrodes 352-354 are separately and electrically connected to the LC capacitors 362 through the conductive lines 3*b*-3*d*.

In comparison with the first embodiment, the present embodiment discloses that the switch electrodes 351-354 are all connected to a potential modulation module 38. The potential modulation module 38 composed of a plurality of IC components can modulate the potentials of its output signals so as to separately control the potentials of the switch electrodes 351-354. Therefore, more complex polarity inversion can be executed under the disclosure of the present embodiment. As shown in FIG. 3(*a*), the potential modulation module 38 outputs a square pulse as a potential modulation signal to each of the switch electrodes 351-354, and the potential modulation signals applied to any two adjacent switch electrodes have reverse phases on their waveforms. Furthermore, as shown in FIG. 3(*b*), a switch electrode set is composed of the switch electrodes 351 and 352, and another switch electrode set is composed of the switch electrodes 353 and 354. The potential modulation module 38 outputs two potential modulation signals having reverse phases separately to aforesaid two adjacent switch electrode sets.

Figure 4:
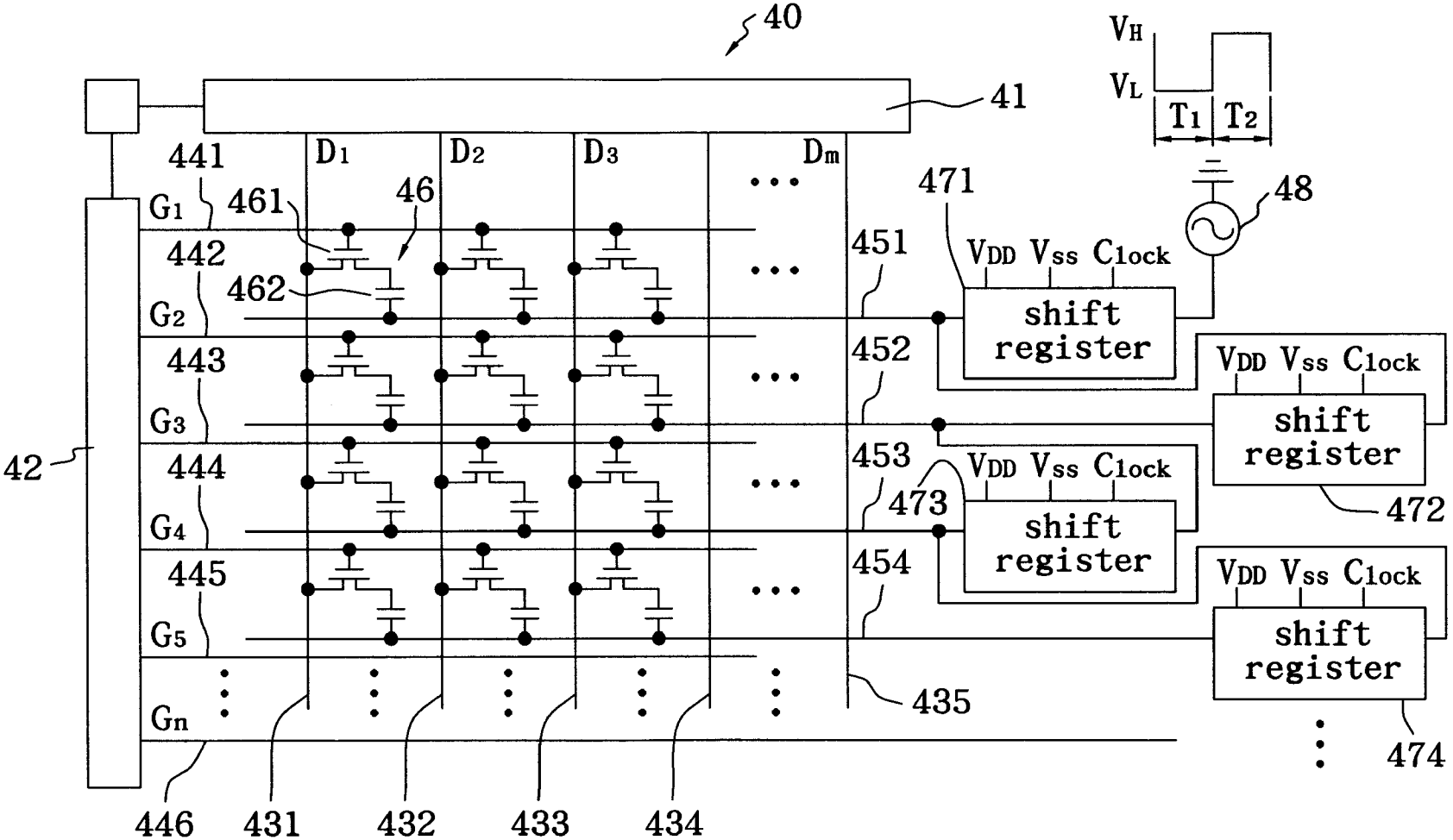
FIG. 4 is an equivalent circuit diagram of an LCD in accordance with the fourth embodiment of the present invention.

FIG. 4 is an equivalent circuit diagram of an LCD in accordance with the fourth embodiment of the present invention. The LCD 40 has a plurality of pixels 36 formed by a plurality of parallel data lines (D1-Dm) 431-435 perpendicularly crossing a plurality of parallel scanning lines (G1-Gn) 441-446. Each of the pixels 36 further includes a TFT 461 and an LC capacitor 462 that controls the rotational direction of the LC molecules. The data lines 431-435 transmit driving signals generated from a data driver module 41, and the scanning lines 441-446 respectively transmit driving signals generated from a scanning driver module 42. All the LC capacitors 462 electrically shorting to a conductive line 4*a* are together electrically connected to a switch electrode 451, and their another terminals are respectively electrically shorts to their corresponding TFTs 461 of which gate electrodes are together electrically connected to the scanning lines 441. The other switch electrodes 452-454 are separately and electrically_ connected to the LC capacitors 462 through the conductive lines 4*b*-4*d*.

In comparison with the first embodiment, the present embodiment replaces the transistors 271-274, respectively, with shift registers 471-474 and provides only one signal source 48 to generate a modulating signal. The output voltage of a shift register 471 is applied to a shift register 472 as an input voltage. In the same way, the output pin of a previous shift register shorts to the input pin of a next shift register. Each shift register further comprises three pins, namely $V_{DD}$, $V_{SS}$ and clock pins. The shift register is enabled while the clock pin is selected. The signal source 48 pulls down at a low potential VL during an interval T1, meanwhile the shift register 471 outputs a high potential VSH its clock pin is selected. During a next interval T2, the signal source 48 pulls up to a high potential VH, meanwhile the shift register 471 outputs a low potential VSL. Since the output pin of the shift register 471 cascades with the input pin of the shift register 472, the switch electrode 451 remains at a high potential VSH during the interval T1, but the switch electrode 452 is at a low potential VSL. In the same way, if the clock pin of each the shift register shorts to each scanning line on the same pixel row, the switch electrode 451 and 453 are all at the same potential level, and the switch electrode 452 and 454 are all also at the same potential level. In other words, the switch electrodes of the odd pixel rows and the even pixel rows have opposite phases of their potentials.

Figure 5A:
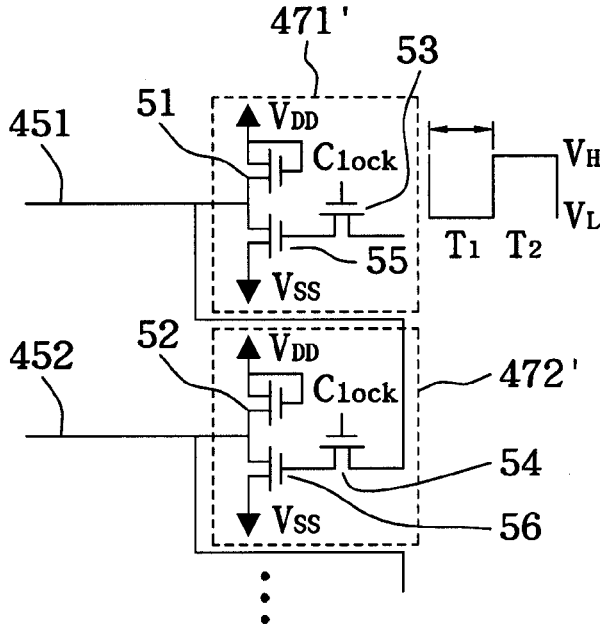
FIG. 5(*a*) is a circuit diagram of the shift register in accordance with the fourth embodiment of the present invention.
Figure 5B:
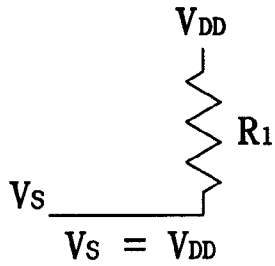
Figure 5C:
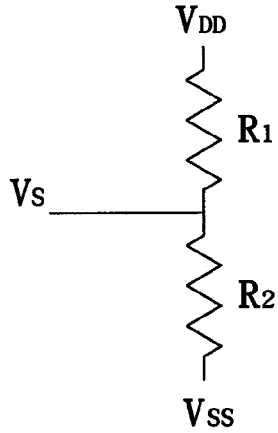

FIG. 5(*a*) is a circuit diagram of the shift register in accordance with the fourth embodiment of the present invention. A shift register 471' is composed of three transistors 51, 53 and 55, wherein transistors 51 and 55 can act as an inverter. The gate electrode of the transistor 53 can be turned on by a clock signal, and square pulses generated from the signal source 48 applies to its source electrode. The gate electrode of the transistor 55 is coupled to the drain electrode of the transistor 53. The source electrode of the transistor 51 is coupled to the $V_{DD}$ pin, and the source electrode of the transistor 55 is coupled to the $V_{SS}$ pin.

During an interval T1, a low potential VL is applied to the source electrode of the transistor 53, meanwhile the potential $V_S$ of the switch electrode 451 remains at a high potential $V_{DD}$ and the scanning signal on the scanning line 441 is applied to the clock pin to enable the shift register 471'. Under the above conditions, FIG. 5(*a*) can be simplified as the equivalent circuit of FIG. 5(*b*). Because the gate electrode of the transistor 55 is at a low potential VL, the transistor 55 is turned off to be an open node. But the transistor 51 is always turned on to enable the switch electrode 451 to short to $V_{DD}$. During an interval T2, the signal source 48 switches the gate electrode of the transistor 55 to a high potential VH so as to turn on the transistor 55. Meanwhile, the potential of the switch electrode 451 is proportional to the ratio of an internal resistance R1 to an internal resistance R2, as shown in FIG. 5(*c*), an equivalent circuit of FIG. 5(*a*). The potential of the switch electrode 451 is given by the following formula:

$$V_S = V_{SS} + (V_{DD} - V_{SS}) \times \frac{R1}{R1 + R2};$$

wherein the potential $V_S$ of the switch electrode 451 approximates $V_{SS}$ when the internal resistance R1 is a relative large value in comparison with the value of the internal resistance R2.

A shift register 472' is also composed of three transistors 52, 54 and 56, whose circuit topology is the same as the shift register 471'. The output voltage of the shift register 471' is coupled to the source electrode of the transistor 54 as the input voltage of the shift register 472'. When the scanning line of the second pixel row is selected, the scanning signal can turn on the shift register 472'. The output voltages of the shift register 471' and 472' are opposite to each other.

Figure 6A:
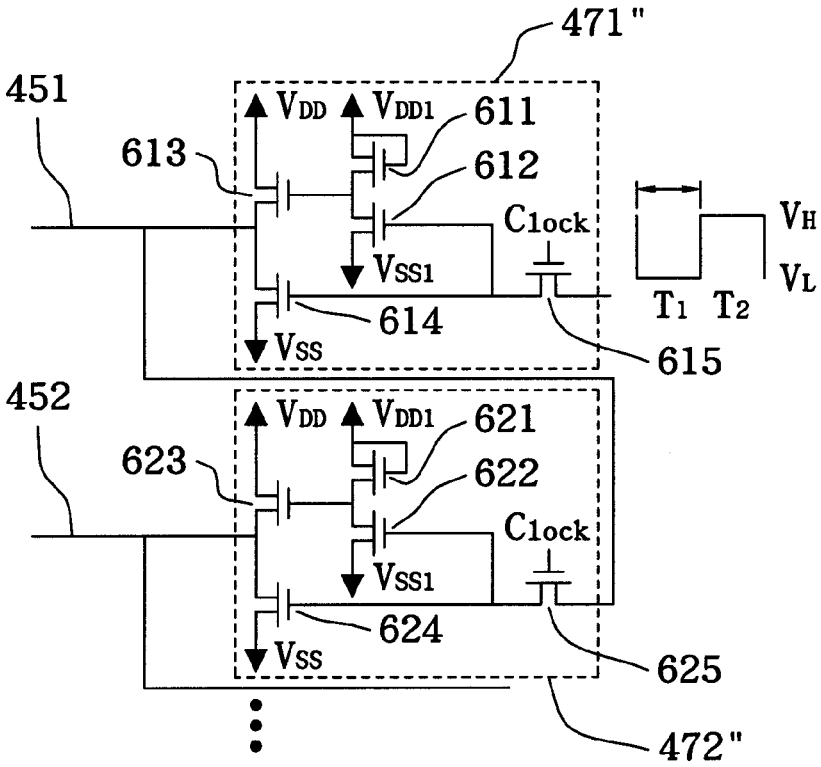
FIG. 6(*a*) is a further circuit diagram of the shift register in accordance with the fourth embodiment of the present invention.
Figure 6B:
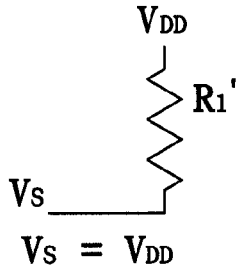
Figure 6C:
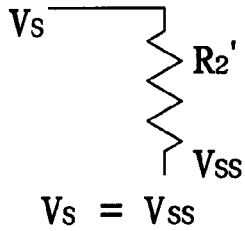

In general cases, the inner resistance of the amorphous silicon channel of a transistor is not controlled due to process variation. FIG. 6(*a*) shows a modified circuit of a shift register to overcome the shift problem of the output voltage in FIG. 5(*a*). A shift register 471" is composed of five transistors 611, 612, 613, 614 and 615, wherein the transistors 611 and 612 can act as an inverter. During the interval T1, the signal source 48 switches to a low potential VL, and the transistor 613 is turned on because a high potential is applied to its gate electrode. The transistor 614 to whose gate electrode is applied a low potential VL is at an off status, hence the potential $V_S$ of the switch electrode 451 remains at a high potential $V_{DD}$ during the interval T1. Under the above conditions, FIG. 6(*a*) can be simplified as the equivalent circuit of FIG. 6(*b*) wherein R1' represents the internal resistance of the transistor 613. During the interval T2, the signal source 48 switches to a high potential VH, and the transistor 613 whose gate electrode is applied a low potential is at an off status. On the other hand, the transistor 614 to whose gate electrode is applied a high potential VH is at an on status, hence the potential $V_S$ of the switch electrode 451 remains at the low potential $V_{SS}$. FIG. 6(*a*) also can be simplified as the equivalent circuit of FIG. 6(*c*) wherein R2' represents the internal resistance of transistor 614.

The above-described embodiments of the present invention are intended to be illustrative only. Numerous alternative embodiments may be devised by persons skilled in the art without departing from the scope of the following claims.

What is claimed is:

1. A driving method for a display apparatus, the display apparatus comprising a plurality of data lines, a plurality of scanning lines, a plurality of conductive lines crossing the plurality of data lines, and a plurality of pixels positioned at a plurality of matrix-arranged unit areas enclosed by the scanning lines and the data lines, each of the plurality of pixels includes a thin film transistor and a liquid crystal capacitor, comprising:

providing a first modulation signal to a first group of the conductive lines; and providing a second modulation signal to a second group of the conductive lines;

wherein each of the first group of conductive lines is electrically connected to a first shift register, and each of the second group of conductive lines is electrically connected to a second shift register.

2. The driving method according to claim 1, further comprising a signal source electrically connected to one of the first shift registers.

3. The driving method according to claim 1, wherein one of the first shift registers shorts to a first conductive line at the first row.

4. The driving method according to claim 1, wherein an output terminal of the first shift register at the first row is connected to an input terminal of the second shift register next to the first shift register.

5. The driving method according to claim 1, wherein each of the first and second shift registers has a first potential pin shorting to a first external potential source, a second potential pin shorting to a second external potential source, and a clock pin shorting to the corresponding scanning line.

6. The driving method according to claim 1, wherein the output terminal of each of the first and second shift registers is at a first potential when the clock pin is selected by the scanning line and meanwhile the input terminal of each of the first and second shift registers is at a second potential.

7. The driving method according to claim 1, wherein the first modulation signal and the second modulation signal comprise square pulses opposite in phase.

8. The driving method according to claim 1, wherein the frequency of each of the first modulation signal and the second modulation signal is synchronized with a frame frequency of the display apparatus.

9. A driving method for a liquid crystal display apparatus, the display apparatus comprising a plurality of data lines, a plurality of scanning lines, a plurality of conductive lines crossing the plurality of data lines, and a plurality of pixels positioned at a plurality of matrix-arranged unit areas enclosed by the scanning lines and the data lines, each of the plurality of pixels including a thin film transistor and a liquid crystal capacitor, comprising:

modulating a first group of the conductive lines by a first modulation signal; and modulating a second group of the conductive lines by a second modulation signal;

wherein the first modulation signal and the second modulation signal are opposite in phase, and are synchronized with multiple times of a scanning frequency of the plurality of scanning lines; and wherein each of the first group of conductive lines is electrically connected to a first shift register, and each of the second group of conductive lines is electrically connected to a second shift register.

10. The driving method according to claim 9, wherein the frequency of each of the first modulation signal and the second modulation signal is equal to a frame frequency of the display apparatus.

11. The driving method according to claim 9, further comprising a signal source electrically connected to one of the first shift registers.

12. The driving method according to claim 9, wherein one of the first shift registers shorts to a first conductive line at the first row.

13. The driving method according to claim 9, wherein an output terminal of the first shift register at the first row is connected to an input terminal of the second shift register next to the first shift register.

14. The driving method according to claim 9, wherein each of the first and second shift registers has a first potential pin shorting to a first external potential source, a second potential pin shorting to a second external potential source, and a clock pin shorting to the corresponding scanning line.

15. The driving method according to claim 9, wherein the output terminal of each of the first and second shift registers is at a first potential when the clock pin is selected by the scanning line and meanwhile the input terminal of each of the first and second shift registers is at a second potential.

* * * * *